US005592850A

United States Patent [19]

Rowan

[11] Patent Number: 5,592,850

[45] Date of Patent: Jan. 14, 1997

[54] MISSILE GUIDANCE SEEKER AND SEEKER MISSILE COUNTERMEASURES SYSTEM TESTING APPARTATUS WITH CO-LOCATION AND INDEPENDENT MOTION OF TARGET SOURCES

[75] Inventor: Herman K. Rowan, Baker, Fla.

[73] Assignee: The United States of America as represented by the Secretary of the Air Force, Washington, D.C.

[21] Appl. No.: 266,413

[22] Filed: Jun. 27, 1994

[51] Int. Cl.[6] ..... G01L 5/14

[52] U.S. Cl. ..... 73/167; 73/865.6

[58] Field of Search ..... 73/167, 865.6, 73/865.9, 866.4; 250/203.1, 504 R, 505.1, 492.1

[56] References Cited

U.S. PATENT DOCUMENTS

| | | | |
|---|---|---|---|
| 3,960,000 | 6/1976 | Barnett et al. | 73/167 |
| 4,106,345 | 8/1978 | Saunders et al. | 73/865.6 |
| 4,193,297 | 3/1980 | Plotkin | 73/167 |
| 4,443,014 | 4/1984 | Kovit et al. | 273/363 |
| 4,729,737 | 3/1988 | Reagan et al. | 434/35 |
| 4,959,015 | 9/1990 | Rasinski et al. | 434/2 |
| 5,133,605 | 7/1992 | Nakamura | 374/124 |
| 5,160,842 | 11/1992 | Johnson | 250/338.1 |
| 5,247,843 | 9/1993 | Bryan | 73/865.6 |
| 5,336,894 | 8/1994 | Ellers | 250/504 R |

*Primary Examiner*—Richard Chilcot
*Assistant Examiner*—Paul D. Amrozowicz
*Attorney, Agent, or Firm*—Gerald B. Hollins; Thomas L. Kundert; David E. Franklin

[57] ABSTRACT

A test system for evaluating the performance of a seeking missile's guidance system under realistic but laboratory-controlled conditions wherein the guidance system is segregated from an actual missile but used to control a multiple degrees of freedom seeker capturing apparatus. The multiple degrees of freedom seeker capturing apparatus is allowed to respond to the seeker's commands in simultaneous of the actual missile's responses to such commands. The test system also provides for the introduction of countermeasures information to the seeker's input field. The test systems may be embodied with the addition of movable elements, e.g., infrared sources to a five-axis flight table apparatus and may employ computer control of the test conditions and results evaluation. Use of the disclosed system to test improved countermeasures devices against known seeker capabilities is also contemplated.

7 Claims, 2 Drawing Sheets

MISSILE GUIDANCE SEEKER AND SEEKER MISSILE COUNTERMEASURES SYSTEM TESTING APPARATUS WITH CO-LOCATION AND INDEPENDENT MOTION OF TARGET SOURCES

RIGHTS OF THE GOVERNMENT

The invention described herein may be manufactured and used by or for the Government of the United States for all governmental purposes without the payment of any royalty.

BACKGROUND OF THE INVENTION

This invention relates to the field of missile guidance seeker and seeker missile countermeasures equipment testing and to the heat responsive and heat image generating examples of such apparatus.

Target seeking missiles have become a standard tool of military engagement. Although these missiles have been arranged to use a number of seeking or guidance arrangements including radar reflection signals, optical scene tracking and in the case of naval missiles or torpedoes sound echoes or sonar, the most practical guidance system for an air-to-air or surface-to-air missiles is based on the use of infrared energy or heat seeking concepts. Missiles of this type are therefore a preferred present day weapon and are often used to destroy an enemy aircraft. The missile accomplishes this mission by tracking the highest temperature or "hot spots" of the aircraft, i.e., by tracking or "locking on to" areas such as the aircraft exhaust system and its discharge gases. The so-called seeker portion of an infrared missile is the actual guidance and control section which enables the missile to track and guide itself toward these "hot spots" of the targeted aircraft. Modern day seeker systems accomplish this tracking function even if the aircraft is changing direction or taking other evasive action. During an actual encounter with an infrared missile an evading targeted aircraft may, of course, eject incendiary flares, which appear as the hottest of the "hot spots" in the infrared scene, in an attempt to decoy the missile away from the aircraft.

A significant amount of testing is required to determine the real life capabilities and vulnerability of both infrared seeker systems and the flares which are used as a countermeasure against them. In order to do this type of testing with low cost and convenience in a laboratory environment, target and flare images must be presented to the seeker being tested in a realistic manner and while the seeker is performing the maneuvers it would normally perform during a real missile flight. The enabling of this laboratory environment testing in a realistic fashion is a primary aspect of the present invention.

The U.S. patent art includes several examples of infrared and infrared simulator apparatus inventions that are of general background interest with respect to the present invention. Included in this patent art is U.S. Pat. No. 5,133,605 issued to T. Nakamura and concerned with a monitoring system employing infrared images; the U.S. Pat. No 5,160,842 of D. A. Johnson which is concerned with a system for infrared fire-perimeter mapping; the U.S. Pat. No. 4,729,737 of R. L. Reagan et al which is concerned with air-borne laser electronic warfare training systems; and the U.S. Pat. No. 4,443,014 issued to B. Kovit et al and concerned with combat simulation means. Although these patents indicate inventive activity in fields relating to the present invention, the prior art appears to have failed to provide a realistic simulation and testing system for the seeker guidance system of a missile or to provide for the testing of countermeasures device characteristics with respect to an energized missile seeker guidance system operating under controlled laboratory conditions.

SUMMARY OF THE INVENTION

The present invention provides a laboratory apparatus in which the characteristics of a seeker missile guidance system maybe tested, characterized, and improved-upon. In a related and conversed manner the present invention also provides a controlled laboratory environment arrangement for testing the characteristics of countermeasures devices that maybe used against seeker missiles. The invention is disclosed in terms of a heat seeker missile and heat generating flare countermeasures devices but is also applicable to seeker systems operating with visible spectrum light energy images, radar-based seeker systems and other seeker missile guidance arrangements achieved heretofore or hereafter.

In the herein principally disclosed infrared arrangement of the invention, there is provided a test arrangement which includes a moveable receptacle for the seeker guidance system of an actual missile weapon together with a flexible multiple image source of signals to be received by this heat seeker guidance system. The invention contemplates realistic movement of the heat signals and closed loop response to these movements by the receptacle which contains the seeker system under test (or the model seeker system when a countermeasure device such as a heat source is being tested).

The invention contemplates evaluation of the seekers' closed loop response to this realistic signal simulation and thereby provides opportunity for both performance testing and performance improvement activity.

It is an object of the present invention therefore to provide a realistic setting for evaluating either seeker missile responses or seeker missile countermeasures techniques.

It is another object of the invention to provide a plurality of realistic signals that are useful in evaluating the performance of a seeker system.

It is another object of the invention to provide a source of target simulation signals for use with a missile seeker system.

It is another object of the invention to provide a source of target confusing or target obscuring countermeasures signals which may adversely affect the performance of a missile seeker system.

It is another object of the invention to provide a source of realistic infrared signals representing both target images and flare countermeasures images together with realistic positioning and moving of these images in the viewing field of a missile seeker.

It is another object of the invention to provide a missile maneuvering simulation system that is responsive to the commands of a missile seeker system captured therein.

It is another object of the invention to provide a missile maneuvering system simulator that is responsive to the normal guidance system controlling signals generated by a missile seeker system.

It is another object of the invention to provide a missile seeker system test bed that may be achieved easily and economically with the aid of apparatus commonly used for a related but different testing purpose.

It is another object of the invention to combine a five-axis flight table-based missile seeker receptacle with a multi image target source apparatus for seeker testing.

It is another object of the invention to provide a computer controlled guidance seeker testing arrangement.

It is another object of the invention to provide a guidance seeker testing arrangement wherein both stimulus signals and result evaluation are accomplished with the flexibility of computer software.

It is another object of the invention to provide a heat seeker guidance system test apparatus wherein initially merged and diverging target and countermeasures images may be presented to the tested heat seeker for performance evaluation of either the heat seeker system or the countermeasures' characteristics.

Additional objects and features of the invention will be understood from the following description and claims and the accompanying drawings.

These and other objects of the invention are achieved by a target seeking missile guidance system test apparatus inclusive of countermeasures response testing ability comprising the combination of:

receptacle means for capturing and moving said guidance system in simulation of missile flight movement thereof in response to missile controlling signals generated in said guidance system;

target signal generating means for impressing a simulated target signal on said captured guidance system;

countermeasures signal generating means for impressing a target confusing simulated countermeasures signal on said captured guidance system;

means for evaluating said missile controlling signals for desirable and undesirable responses to variations in said simulated target signal and said simulated countermeasures signal.

DETAILED DESCRIPTION

Figure 1:
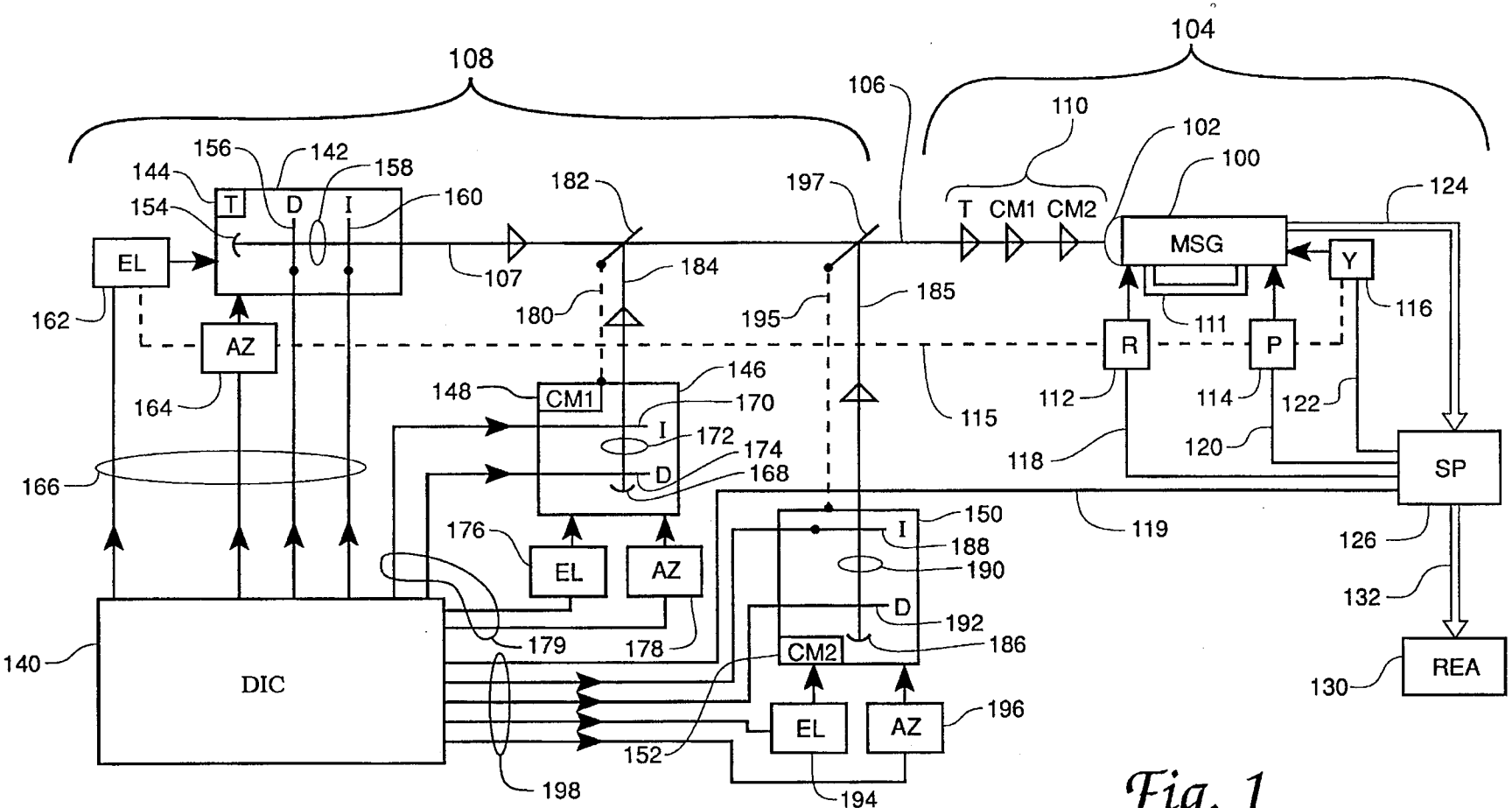
FIG. 1 is a block diagram of a test system according to the present invention.

In order to economically evaluate the performance of a seeker missile guidance system, such as a heat seeking system, in a meaningful manner it is desirable for the missile-dismounted seeker system to be incorporated in a closed loop environment. In this environment the seeker receives heat image input signals and the output signals from the seeker system are used to orient the seeker's physical attitude and position just as would occur with the seeker system attached to its intended warhead and propulsion system inclusive missile body. In this closed loop testing arrangement testing signals applied to the heat image source apparatus should be reflected in the seeker systems electrical output signals and these signals can be both evaluated for their desired characteristics and used to initiate additional input to the heat image source apparatus.

This type of testing is called hardware in the loop testing. The realistic testing of infrared seeker apparatus in a hardware in the loop manner therefore requires equipment such as a multiple axis flight table to receive the seeker system and a scene projector to provide optical data input, such a combination enabling the seeker to perform maneuvers during a test just as it would during a real live flight. In this testing, the scene projector, for example, presents a target ejecting flares, a realistic "countermeasure" to the seeker. The seeker along with the scene projector and a five-axis flight table, for example, are all preferably interfaced to a computer for flexible control and manipulation of seeker environment conditions during a test.

According to a preferred, and herein described arrangement of such a testing system, the innermost three axes of a five-axis flight table (i.e., roll, pitch, and yaw axes), where the seeker is mounted, give the seeker the capability to accomplish the maneuvers which are done during its flight. The outer axes of the flight table (elevation and azimuth) are then used to mount a scene projector, i.e., the missile's target generator. In this system a simulating of a target of the missile—a target flying a given speed on a predetermined heading can be accomplished when the outer two axes of the flight table, which are carrying the scene projector, are moved in a controlled manner. Meanwhile, the seeker is tracking the target and controlling the inner three axes of the flight table in order to guide itself toward the target. The motion of the inner three axes of the flight table therefore represents the maneuvers of the missile which are executed in a real flight against a real aircraft.

One purpose of performing hardware in the loop testing is therefore to simulate an actual flight of an infrared seeker that is trying to reach a flare ejecting aircraft. A goal of this simulation can be to improve the characteristics of the seeker itself or alternatively to improve the characteristics of the flares with respect to a particular combination of seeker characteristics. The outcome of these tests can define how effective flares actually are in decoying an infrared seeker and also how effective the infrared seeker is in rejecting the flares. All of this can be accomplished without incurring the overhead costs of missile flight using the present system.

FIG. 1 in the drawings shows a test system according to the present invention in block diagram form. A missile guidance system 100 which includes an infrared image responsive optical input system 102 is shown positioned in a receptacle 111 that is in turn controlled by the centermost three axes controls of a five-axis flight table apparatus. Flight table apparatus of the type useable in the FIG. 1 system are well known in the missile testing and related arts and are available, e.g., as electrohydraulic simulators from manufacturers such as Carco Electronics of 195 Constitution Drive, Menlo Park, Calif. 94025 under the nomenclatures of Models S-450R-5 and Model S-458R-5T. The catalog listing for the Model S-450R-5 shows a five axis system in which an innermost axis receptacle, as may be employed to receive the guidance system 100 in FIG. 1, is shown along with the outer arm member. A portion of such an outer arm is shown at 200 in FIG. 2.

Returning to FIG. 1, the guidance system 100 is attended by a plurality of associated system elements, these elements and the seeker are generally indicated at 104. Additionally shown in FIG. 1 are a plurality of elements 108 which serve to present heat image data to the seeker and its elements 104 by way of the optical coupling path 106. The infrared image source elements 108 are arranged to provide a target image, a first countermeasures image and a second countermeasures image, all as real optical images and all as indicated at 110 along this path 106 to the guidance system 100.

In the seeker and its elements portion of the FIG. 1 system, the guidance system 100 is shown to be positionally and orientationally controlled by the innermost three axes elements of an above described five axis table apparatus. The innermost three axes are identified as the roll, pitch and yaw axes and controls for these axes are indicated at 112, 114 and 116. Signals generated by the guidance system 100 such as would normally be applied to a missile's flight control system are communicated along the path 124 to a signal processing apparatus 126. The signal processing apparatus provides individual roll, pitch and yaw signals along the paths 118, 120, and 122. The guidance system signals received in the signal processor 126 along the path 124 are also coupled to a result evaluation apparatus 130 along the path 132 in order that the performance of the guidance system 100 and its response to the images received along the path 106 can be evaluated. Supplemental information regarding the data received along the optical path 106 may also be provided to the signal processing system 126 by way of the path 119 to the data input computer 140. This supplemental information is in addition to the primary and real life characterized data of an optical nature that is received along the optical path 106. The supplemental information may include test control and true value signals that enable better evaluation of the guidance system's response to an optical signal.

In the infrared image source elements 108, there is provided an externally controllable target image source 142 which is designated at 144 as being a target source, an externally controllable countermeasures image source 146 which is designated at 148 as relating to a first countermeasures image and an externally controllable countermeasures image source 150 which is designated at 152 to be a second countermeasures image.

As is more fully described below, it is the intent of the present invention that the image source elements 108 provide an aircraft simulating moving target image and two co-located countermeasure flare images along the path 106 to the guidance system 100. According to further aspects of the invention, it is desired that the countermeasure flare images from the sources 148 and 150 in FIG. 1 be arranged to diverge from a coincident with the aircraft image status during operation of the FIG. 1 system in simulation of hot flares leaving a target aircraft during a missile defensive maneuver. In order to accomplish these target image and countermeasure images movements, each of the image sources 142, 146 and 150 is provided with independent elevation and azimuth controllers as are indicated at 162, 164, 176, 178, 194, and 196, respectively. Signals for operating these elevation and azimuth controllers are generated by the data input computer 140 and are provided by way of the communication paths indicated at 166, 179, and 198. The nature of the controlling action desired from the elevation and azimuth controls for the infrared sources 142, 146 and 150 is discussed in connection with FIG. 2 below. As is indicated by the additional signal communication provisions in the paths 166, 179 and 198, other parameters of the true images represented in the FIG. 1 system are also controlled by the computer 140.

Figure 2:
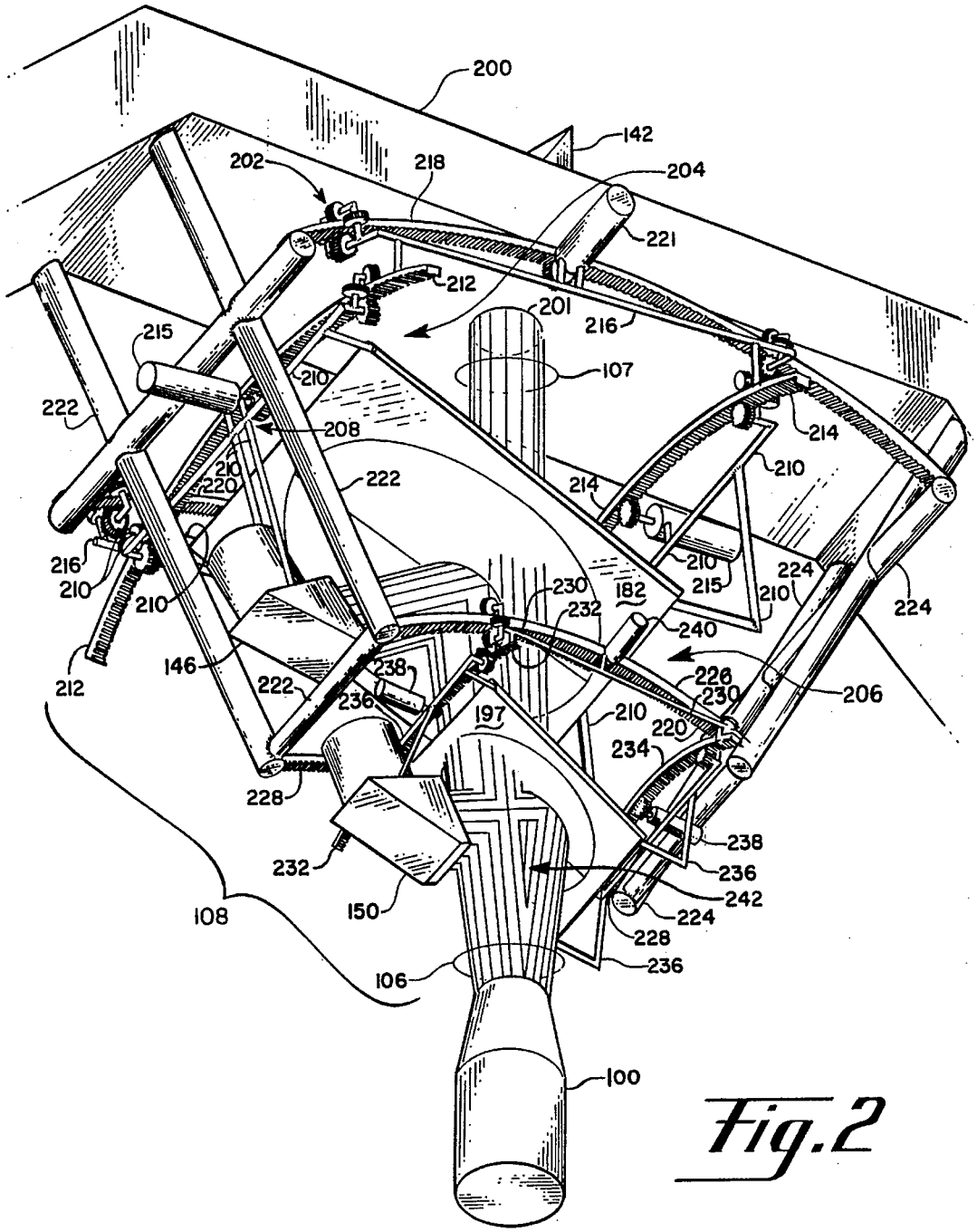
FIG. 2 is an isometric view of a thermal image generating apparatus for use in the FIG. 1 testing system.

A flow chart of the gross steps to be performed in the computer 140 in order to operate the FIG. 1 and FIG. 2 testing apparatus is included as an appendix appearing at the end of this specification. The appendix describes algorithms for target image position and size, two countermeasure flare ejections, flare size changes, and repeated updating of target data and flare positions. Specific computer program steps in one of many possible programming languages can be accomplished by persons skilled in the computer programming art from these appendix-recited steps.

Within each of the infrared image sources 142, 146, and 150, there is preferably disposed a black body cavity-shaped infrared emitter as is indicated at 154, 168 and 186 in FIG. 1. These black body emitter elements are preferably heated to the desired infrared spectrum emitting temperature by way of electrical resistance elements which are not shown in the FIG. 1 drawing. Infrared energy emitted by these black body sources is controlled in quantity by a circular variable neutral density filter apparatus which is indicated at 156, 174 and 192 in the three infrared energy sources of FIG. 1. Signals for controlling the three energy quantity determining circular variable neutral density filters 156, 174 and 192 are also received from the data input computer 140 via the paths 166, 179 and 198.

Each of the infrared image sources 142, 146, and 150 also includes an optical system, as is generally indicated at 158, 172, and 190 in the FIG. 1 drawing, for collimating and otherwise optically manipulating the energy emitted by the sources. The diameter of the real image presented by the three sources 142, 146, and 150 is individually controlled for each image by an iris member as indicated at 160, 170 and 188 respectively in the three infrared sources. By way of controlling the physical size, intensity and location of a countermeasures image for example, the appearance of a hot flare leaving a target aircraft at a test selectable distance from the missile can be realistically simulated.

The three infrared images generated by the sources 142, 146 and 150 in FIG. 1 are combined for presentation to the guidance system 100 by way of a pair of beam splitter elements 182 and 197, which are located in the path 106 and are physically moved in connection with movement of the sources 146 and 150, as is indicated by the physical connections indicated at 180 and 195 in the FIG. 1 drawing. By way of these physical connections the elevation and azimuth controls for the countermeasures image generators 146 and 150 also determine the physical positioning of the beam splitters 182 and 197. The countermeasures image input to each of these beam splitter elements arrives along the paths 184 and 185 in FIG. 1.

As has been indicated above, the FIG. 1 testing apparatus is preferably arranged around a five axes flight table apparatus with three of the five axis being used to control the roll, pitch and yaw components of the guidance system is attitude and the remaining two of the five axes being used to control the target image source 142 by way of the elevation and the azimuth controllers 162 and 164 in FIG. 1. The dotted line at 115 is used to indicate the relationship of the controllers 162, 164, 112, 114, and 116, even though the physical action of these controllers is understood to be independent and determinable by the computer 140.

FIG. 2 shows preferred embodiment details of the infrared image source elements 108 and their physical relationship to the guidance system 100 in the present invention. Generally, FIG. 2 shows a feasible disposition of the three infrared energy sources 142, 146 and 150 (that were shown in schematic form in the FIG. 1 drawing with respect to the guidance system 100). The target infrared image source 142 is preferably mounted on the outer arm member 200 of the five axis flight table apparatus with an aperture 201 allowing communication of the infrared energy beam 107 from this source to the guidance system 100.

Also mounted on the outer arm member 200 are the frame members 222 and 224 which may be referred to as outer arm supported frame members. By way of an additional series of four moveable frame members, the outer arm frame supported members are used to support the countermeasures sources 146 and 150 and their physically associated beam splitters 182 and 197. The first of the moveable frame members is shown at 216. As may be observed at 202 this first moveable frame member is mounted with a series of pinion members on a generally horizontally disposed pair of curving rack members 218 and 220 which are in turn mounted on the outer arm supported frame members 222 and 224. Movement of the first frame member 216 in the generally horizontal direction of FIG. 2 is controlled by a pair of geared positioning motor members, one of which is visible at 221 near the top of FIG. 2.

In a similar manner, the second moveable frame member 210 with its multiple parts is disposed on the generally vertically disposed pair of rack members 212 and 214 which are suspended on the first moveable frame member 216. The beam splitter 182 by which the infrared energy from the first countermeasures infrared source 146 is combined with the beam 107 from the target infrared source 142 is suspended directly on this second moveable frame member 210. As may be observed in the left hand portions of FIG. 2, the first countermeasures source 146 is also suspended on the moveable frame member 210. Movement of the second moveable frame member 210 in the generally vertical direction along the racks 212 and 214 is accomplished by a second pair of geared positioning motor members 215.

In a similar manner, the third and fourth moveable frame members 230 and 236 are suspended from the horizontal and vertically disposed curved rack member pairs 226, 228 and 232, 234 and these rock members are mounted on the outer arm supported frame members 222 and 224. Position along the curved racks 226, 228, 232, and 234 is controlled by the geared positioning motor member pairs 240 and 238, respectively. The second countermeasures source of infrared energy 150 and its associated beam splitter 197 are mounted on the fourth frame member 236. By inspection it is possible to relate the geared position motor pair 238 in FIG. 2 to the elevation controller 176 in FIG. 1 and the geared positioning motor pair 240 to the azimuth controller 178 in FIG. 1. Similar relationships exist between the geared positioning motor pairs 215 and 221 and the elevation and azimuth controllers 162 and 164 in FIG. 1.

Upon reflection, it may be appreciated that the moveable frames and positioning motor apparatus of FIG. 2 allow independent movement of the countermeasures image sources 146 and 150 with respect to the image source 142 and this independent movement can achieve both full merger of the three images from these sources and subsequent divergence of these images as is useful to simulate the ejection of burning flares from a seeker-defending aircraft. It is additionally notable that this independent movement of the countermeasures images occurs with respect to the outer frame member of the five axis flight table. The countermeasures one and countermeasures two images from sources 146 and 150, respectively, are represented to be in six degree left and six degrees right displaced positions with respect to the target image beam at 107. This displacement is particularly visible in the triangular shaped representation of beam components from each of the three sources that appears at 242.

In FIG. 2, the guidance system 100 is preferably located at the center of curvature of the curving rack members 218 and 220, 212 and 214, 226 and 228, 232 and 234. As indicated above, the guidance system 100 is presumed to be suspended in a receptacle that is carried on the inner-most three axis or roll, pitch, and yaw axes of the five axis flight table apparatus.

For description purposes it is convenient to consider that the curving racks 218, 220 and 212, 214 and their associated frame members 216 and 210 comprise a first countermeasures infrared source suspension system, a suspension system which may be identified with the number 204. Similarly the second countermeasures source 150 is suspended on a suspension system 206. The overall nature of the suspension system for the countermeasures image one source and the geared positioning motor members 215 is therefore particularly visible in the region 208 of FIG. 2.

FIG. 2 in summary shows the position of the seeker, to be located at the center of all axis of the flight table. A plus and minus six degree field of view cone and a seeker requiring five inches of collimated energy from the infrared sources are also represented in FIG. 2. Also shown is the outer arm 200 of the flight table which is used to provide motion for the scene projector. To simulate an aircraft engine or a flare in the infrared spectral region "hot spots" must be generated that are equal in size and intensity to an engine or flare image. In order to simulate these "hot spots" the blackbody sources are used in FIG. 2 along with the iris shown at 160, 170 and 188 in FIG. 1. The iris is essentially an aperture which controls the size of the "hot spot". An attenuator is also used along with the blackbody to control the intensity of energy coming from the blackbody, these attenuators are represented by the diaphragms 156, 174 and 192.

The optical system of an infrared seeker is intended to detect "hot spots" from a long distance, therefore an optical-collimating system is used with a blackbody source that is located at close range in order to simulate a hot spot that is very far from the seeker. This collimating system produces parallel rays of energy which appear to originate in a far-away source as required by the seeker's optical system. In the present invention infrared sources the blackbody is disposed in a fixed position located at the focal point of the collimating system. This disposition eliminates complex optical arrangements which would move the blackbody in the focal plane of a collimating system to accomplish infrared source motion.

To simulate flares being ejected from an aircraft the infrared sources must be co-located with each other so that a flare appears to leave the aircraft. In order to co-locate the three infrared sources, the illustrated two beam splitters are used to fold two infrared sources into the seeker's field of view while allowing the third infrared target source to transmit directly through the beam splitters to the seeker 100. The resulting three images along the path 106 are represented at 110 in FIG. 1 where T represents target and CM represents countermeasure. Similar image representations are shown along the output path 107 etc. of each source in FIG. 1. The infrared source 142 located on the outside of the outer arm 200 of the flight table represents the target and the two inner infrared sources represent the two countermeasures flares. The two beam splitters 182 and 197 reflect energy from the infrared sources to the seeker's field of view while allowing energy from the other infrared sources (target and one countermeasures source) to transmit through o the seeker 100. The substrate for the beam splitters in this case is preferably silicon because silicon is transmissive to infrared energy. Other substrates can be chosen for other specific energy wavelengths.

FIG. 2 therefore shows a ray trace of each infrared source being reflected and transmitted by the beam splitters to the seeker. At the point where the seeker's optical system is located, which is also the center of all axis of the flight table, the three infrared sources each provide the 5 inches of collimated energy.

In order to simulate flares being ejected from the aircraft, images from the two infrared sources 146 and 150, which represent flares, must be able to move in an angular direction away from the infrared source image representing the aircraft. In the present invention, the energy from each flare infrared source is movable over plus and minus six degrees in any angular direction with respect to the seeker's boresight angle, which is the angle off of the mechanical body axis of the seeker. To accomplish this movement the rays from the collimated infrared flare source system must be moved in an arc whose radius of curvature is equal to the distance to the center of all axes of the five axes flight table. As shown in FIG. 2, the collimating infrared source system is arranged to travel on arced rails where the radius of curvature of the rails is equal to the distance from the rail to the intersection of all axes of the flight table. By moving the collimated infrared flare source in this arced manner the infrared source will always be directed at the seeker.

Each beam splitter must be large enough to accommodate the maximum angular motion (which is the maximum field of view of the scene projector) of its infrared source without the energy that is being transmitted through that beam splitter falling off the edge of the beam splitter. The clear aperture size of the beam splitters need for this case is an ellipse with the major axis being 22.8 inches and the minor axis being 10.8 inches for the larger beam splitter and for the smaller beam splitter the ellipse has a major axis of 12.5 inches with a minor axis of 6.3 inches.

Alternate arrangements of the above disclosed aspects of the present invention are possible, for example, the infrared source that represents an aircraft can have independent motion capability by adding another arced rail assembly. Different infrared sources (such as an infrared source representing multiple engines) can also be employed and additional flare and target rail assemblies can be added to give an expanded capability for hardware in the loop testing.

FIG. 1 shows the evaluation of the seeker guidance system output signals to reside in the block 130. It is of course possible to achieve this evaluation through the use of computer software located in the data input computer 140. In this arrangement the computer is performing both the test determination and controlling functions and in addition is provided with the capability for comparing results with an expected standard and other evaluation steps.

While the apparatus herein described constitute a preferred embodiment of the invention, it is to be understood that the invention is not limited to this precise form of apparatus and that changes may be made therein without departing from the scope of the invention which is defined in the appended claims.

I claim:

1. Missile heat seeker and heat seeking missile countermeasures testing apparatus comprising the combination of:

a hot target image simulating source of radiant energy movably disposed within the viewing field of a test missile guidance system;

a hot countermeasures image simulating source of radiant energy disposed in movable image relationship with said hot target image simulating source of radiant energy and within the viewing field of said test missile guidance system;

first externally controllable image determining means connected with said hot target image simulating source of radiant energy for positioning, moving, and additionally controlling the hot target image in response to a first testing algorithm;

second externally controllable image determining means connected with said hot countermeasures image simulating source of radiant energy for positioning, moving, and additionally controlling the hot countermeasures image in response to a second testing algorithm;

responsive means connected with said test missile guidance system for physically positioning and moving said test missile guidance system relative to said hot target image and said hot countermeasures image in response to signals from said test missile guidance system generated in response to said hot target image and said hot countermeasures image; and means for evaluating the response of said test missile guidance system to changes in input data provided to either of said first and second testing algorithms.

2. The test apparatus of claim 1 wherein:

said responsive means includes a physical receptacle capable of receiving said test missile guidance system;

said physical receptacle and said test missile guidance system are disposed adjacent a center of all axis point in a five axis flight table apparatus;

said physical receptacle and said test missile guidance system are positionally and orientationally controlled about said center of all axis point by physical connections with missile roll, pitch, and yaw maneuver representing first, second, and third axis control elements of said five axis flight table apparatus;

said hot target image simulating source of radiant energy is positionally controlled with respect to said physical receptacle and said test missile guidance system by physical connection with fourth and fifth axis control elements of said five axis flight table apparatus;

said hot countermeasures image simulating source of radiant energy is positionally controlled with respect to said physical receptacle and said missile guidance system by physical connection with said fourth and fifth axis control elements of said five axis flight table apparatus and by additional countermeasures image control signals;

said apparatus further includes optical beam splitting means for combining said hot target image and said hot countermeasures image.

3. The test apparatus of claim 2 wherein;

said first externally controllable image character determining means includes target data signal conducting means communicating signals representing said first testing algorithm to said fourth and fifth axis control elements of said five axis flight table apparatus for determining target image position and movement input data to said missile guidance systems;

said second externally controllable image character determining means includes countermeasures data signal conducting means communicating signals representing said second testing algorithm to mechanical control means for determining countermeasures image position and movement input data to said missile guidance system; and said testing apparatus further includes missile guidance system output conducting means communicating output signals generated by said missile guidance system to an input signal port of said first, second and third axis control elements of said five axis flight table apparatus for moving and orienting said missile guidance system in response to said first and second testing algorithm input data in simulation of missile flight movements.

4. The testing apparatus of claim 3 wherein said first and second externally controllable image character determining means each also include infrared signal attenuator means and infrared signal size controlling aperture means for additionally determining the character of said hot target and said hot countermeasures images.

5. The testing apparatus of claim 3 wherein said first and second testing algorithms in combination include means for simulating heated aircraft apparatus and means for simulating an emergence and separation from said heated aircraft apparatus of an incendiary flare countermeasures image.

6. The testing apparatus of claim 1 herein said hot countermeasures image simulating source of radiant energy includes first and second incendiary flare image simulating apparatus.

7. The testing apparatus in claim 1 wherein said hot target image simulating source of radiant energy and said hot countermeasures image simulating source of radiant energy each include collimated sources of infrared energy of a real optical image generating capability.

* * * * *